US005465516A

United States Patent [19]

Stabile

[11] Patent Number: 5,465,516

[45] Date of Patent: Nov. 14, 1995

[54] VALANCE ASSEMBLY

[75] Inventor: David J. Stabile, Atlanta, Ga.

[73] Assignee: Miller/Zell, Inc., Atlanta, Ga.

[21] Appl. No.: 212,944

[22] Filed: Mar. 15, 1994

[51] Int. Cl.[6] ..... G09F 3/20

[52] U.S. Cl. ..... 40/649; 40/642; 40/611; 248/220.22

[58] Field of Search ..... 40/642, 649, 611; 16/225; 248/289.1, 282

[56] References Cited

U.S. PATENT DOCUMENTS

| | | | |
|---|---|---|---|
| 2,787,382 | 4/1957 | Williams | 108/153 X |
| 2,936,904 | 5/1960 | Streater | 40/649 X |
| 3,889,408 | 6/1975 | Offner | 40/642 X |
| 4,194,313 | 3/1980 | Downing | 15/225 X |
| 4,669,208 | 6/1987 | Stoddard | 40/642 X |
| 4,828,132 | 5/1989 | Francis, Jr. et al. | 16/225 X |
| 5,346,076 | 9/1994 | Hart | 40/642 X |

*Primary Examiner*—Kenneth J. Dorner
*Assistant Examiner*—James O. Hansen
*Attorney, Agent, or Firm*—Hopkins & Thomas

[57] ABSTRACT

A valance assembly designed for attachment to existing, in-store display fixtures is disclosed. The valance assembly is completely assembled prior to in-store delivery, and requires only the unfolding of hinged mounting brackets for installation. The valance assembly is intended to carry graphics displays or headers such as advertisements or merchandise promotional information.

18 Claims, 1 Drawing Sheet

VALANCE ASSEMBLY

FIELD OF THE INVENTION

This invention relates to a decorative valance assembly which also serves as a graphics display support unit. The valance assembly is especially designed to mount onto an in-store display fixture, such as point-of-sale merchandise shelving or gondolas. The supporting fixture either can be free-standing or wall mounted units which include shelves or other means for displaying merchandise. The valance assembly of the present invention is readily installed onto and removed from common point-of-sale display units, and is designed to be mounted to presently existing in-store units. The assembly is designed to require no construction at the store site, but merely can be unfolded from a storage position and mounted onto the fixture. The valance assembly preferably is mounted along the uppermost portion of the display unit, above the merchandise, although it also can be mounted at any other vertical location on the display unit above the floor. The present invention permits an elongate, planar graphics display to be inserted into or removed from the valance assembly.

BACKGROUND OF THE INVENTION

Point-of-sale or point-of-purchase, in-store display fixtures commonly are used as a way of presenting merchandise for display to prospective purchasers. Typically, such display fixtures or display units are comprised of vertically oriented standards or uprights supported by a base member and braces. The uprights ordinarily support, in cantilever fashion, shelves or horizontally disposed shelf supports. Some known display units include a substantially rectangular grid or framework which not only structurally supports the unit, but also carries shelves.

Merchandisers predominately utilize in-store advertizing or informational displays to promote their products. Such promotional items take the form of graphic displays, such as banners, headpieces and other printed materials, suspended by various means either adjacent to or attached to the product display fixtures. Often these graphic display units require extensive "in-store" assembly and construction or are self-standing units which can interfere both with customer flow or with the display of the products themselves. Systems which require in-store construction often either require tools for assembly or are not readily assembled by temporary or unskilled labor that typically are utilized by some merchandising outlets to perform such tasks. Consequently the labor costs for assembling and installing prior display units increase if skilled labor is required or even if unskilled labor is used, since more time is required for assembly.

Additionally, these known promotional displays typically are made for a single graphics item only, and must be discarded or removed when the new material or promotional item is advertised. It is thus believed that a need exists for a graphics display unit, such as the modular valance assembly of the present invention, which is designed for "pre-site assembly", and so readily can be mounted onto existing in-store product display fixtures, being positioned for maximum customer viewing and minimum interference with customer flow and product presentation.

SUMMARY OF THE INVENTION

Briefly described, the invention comprises a valance assembly especially adapted to be mounted to an in-store, point-of-purchase display fixture. The valance assembly is modular, capable of being selectively installed in sections, as needed, and is preassembled prior to its delivery to the merchandising outlet so as to essentially require no in-store assembly. The assembly includes a graphics panel which is elongate and capable of accepting a substantially planar graphics display or insert along one side. The graphics insert is slidably received between two inwardly directed, opposed guides attached to the front of the graphics panel. The opposite side of the graphics panel includes preassembled retaining means for cooperating with an in-store display fixture. The valance assembly, for example, is installed onto the display fixture by being attached along the upper portion of the display fixture, above the merchandise or products. The graphics insert is removably held by the valance assembly, presenting the intended advertising or informational message to perspective customers. The graphics insert readily can be removed and replaced with another graphics insert or display, at the merchandiser's discretion.

The valance assembly generally is capable of being aligned with other assemblies, and so is designed to extend along the entire length of the display fixture, if desired. One end of each modular, graphics panel is tapered so as to nest with an untapered end of an adjacent panel. When sections of these graphics panels are so arranged and nested in horizontal alignment, the modular panels appear to be one elongate graphics unit extending the entire length of the display fixture.

The mounting means which connects the graphics panel to the merchandising display fixture preferably is in the form of a mounting bracket hingedly connected to the rear surface of the graphics panel. The mounting bracket, therefore, can be placed in a storage position adjacent to or substantially parallel to the graphics panel rear surface. Alternately, the mounting bracket can be biased away from the graphics panel rear surface at an angle, for example 90° , into a mounting position. This allows the valance assembly to be partially collapsed into a storage position and stacked with other such valance assemblies for storage or transportation. When the valance assembly is to be installed onto a display fixture, the mounting brackets hingedly connected to the graphics panel merely are biased outwardly, and the valance assembly is ready to be installed.

Accordingly, it is an object of the present invention to provide a modular valance assembly which can be anchored to in-store merchandise display fixtures, and which is adapted to hold an informational or advertised graphics display for customer viewing. The invention also is designed to be readily installed in an in-store environment to existing display fixtures without assembly.

It is another object invention to provide a preassembled valance assembly which can be partially collapsed by folding the associated mounting brackets against the graphics panel and for storage or transportation. Such valance assemblies readily are installed simply by unfolding the mounting means and connecting the graphics assembly to an in-store display fixture. Other objects, features and advantages of the present invention will become apparent upon reading the following specification in conjunction with the accompanying drawing figures.

Figures 1, 2, 3A, 3B, 4:
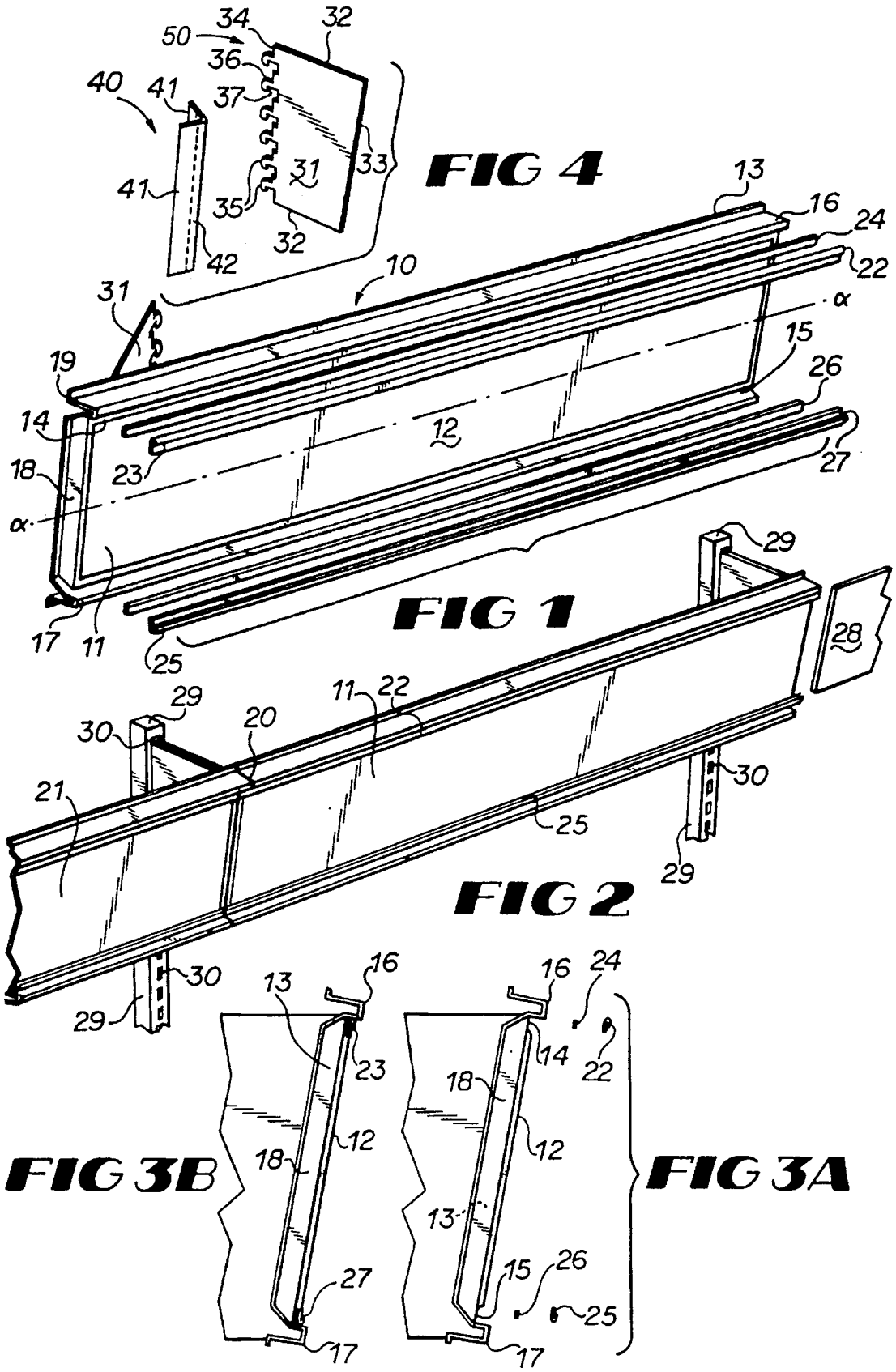
FIG. 1 is a perspective, partially exploded view of one embodiment of the present invention.
FIG. 2 is a perspective view of the embodiment of FIG.

1 shown installed onto a display fixture.

FIG. 3A is an elevated, partially exploded end view of the embodiment of FIG. 1.

FIG. 3B is an elevated end view of the embodiment of FIG. 1.

FIG. 4 is an exploded perspective view of the mounting bracket assembly.

DESCRIPTION OF THE PREFERRED EMBODIMENTS

Referring now to the drawing figures in which like reference numerals represent like parts throughout the several views, FIG. 1 shows a valance assembly 10. The valance assembly includes an elongate graphics panel or frame 11. Frame 11 preferably is comprised of a substantially rigid, plastic material such as polystyrene. Even though the frame is substantially rigid, it is nevertheless somewhat flexible, since the approximately ⅛ inch thick styrene material necessarily can be flexed. Ideally, the graphics panel is shaped by a vacuum forming method well known in the art, to form its integral features. The graphics panel includes a front side or surface 12 which is substantially rectangular, planar and elongate, and a rear side or surface 13, opposing the front surface 12. The vacuum forming process for shaping the graphics panel forms several features integral to the unitary graphics panel, including upper channel or recess 14 positioned above front side 12 and extending parallel to the longitudinal axis α of the graphics panel. Similarly, lower recess or channel 15 is formed in the graphics panel below front side 12, also parallel to longitudinal axis α. An outwardly extending, upper ridge 16 overhangs front surface 12 and projects away from rear surface 13. An identical, lower ridge 17 is positioned below lower channel 15 and also extends away from rear side 13. The upper and lower ridges comprise decorative borders, as is discussed hereinafter.

At each end of the graphics panel 11 are formed rearwardly extending, identical flaps 18. At one end of the graphics panel, for example the left end as shown in FIG. 1, the graphics panel is tapered along its entire end and along its vertical dimension. This tapered section 19 allows one end of the graphics panel to nest or tuck beneath an adjacent graphics panel end which is not tapered, such as end 20 of an adjacent panel 21. Panel 21, as shown in FIG. 2, is identical to panel 11. The valance assembly of the present invention, therefore, is modular in that several sections of the valance assembly can be mounted to nest together to form an elongate panel extending the entire horizontal length of an in-store display fixture.

Guide 22 is received in elongate, longitudinally extending channel 14. The guide is substantially "J-shaped" in cross section, the curving portion of which defines an inwardly opening channel 23, which extends the length of guide 22. Guide 22 can be attached to the graphics panel above front surface 12 and within channel 14 by double-sided tape 24, although any other type of adhesive suitable for bonding the guide to the graphics panel is appropriate. An identical guide 25 is attached by double-sided tape 26, or other suitable attachment means, to the graphics panel below front side surface 12 within channel 15. Guide 25, however, is inverted with respect to the position of guide 22 so that the elongate channel 27 formed by the curved portion of substantially J-shaped guide 25 also extends inwardly, opening toward upper guide 22.

Since guides 22 and 25 both include inwardly opening channels and are spaced apart from each other, a substantially planar, elongate graphics insert or header can be slid between guides 22 and 25 to be releasably retained by the guides and positioned adjacent front surface 12o Alternately, if the graphics insert is flexible along its longitudinal axis, the insert can be placed to engage either the upper or lower guide, and bent along its longitudinal axis to be placed within the opposing guide. When the graphics insert is allowed to return to its substantially planar shape, the insert will be held between the opposing, spaced guides. It is also appreciated that the U-shaped portion of guides 22 and 25 releasably retain the graphics insert 28 to graphics panel 11.

As discussed, the valance assembly of the present invention is designed to be mounted onto an in-store, point-of-purchase display fixture. FIG. 2 shows a portion of a display fixture, having vertically upstanding supports or uprights 29 which define along their front side surfaces elongate openings 30. Such display fixture uprights having openings along one side are well known in the art, and are adapted to support, in cantilever fashion, shelving or other merchandise support members. The valance assembly of the present invention also is especially adapted to be mounted to such display fixture uprights. To accomplish this mounting, the present invention utilizes mounting assembly 50. Assembly 50 includes a mounting bracket 31 which is planar, substantially rectangular shaped, having opposing, straight upper and lower edges 32, and vertical, straight front edge 33. Opposing the edge 33 is rear edge 34, which defines display fixture upright engaging members or teeth 35. Although the embodiment shown in the present invention includes six, spaced, rearwardly extending upright engaging teeth, the present invention can function suitably with less than six engagement members, but preferably no less than three equally spaced engagement members. The engagement members of the present invention are of the same thickness as the remainder or body portion of the mounting bracket itself, being formed integrally therewith. Preferably, mounting bracket 31 is formed of stamped, substantially rigid polystyrene.

Engagement members 35 are generally well known in the art, having an upper curved portion 36 and a lower vertically extending edge portion 37 adapted to engage the upright and hold the mounting assembly 50 onto the uprights when teeth 35 are inserted into openings 30. This means of engaging the mounting assembly to the upright using the engagement member 35 is employed since it is well known in the art and widely used. The present invention therefore, is readily installed onto existing in-store display fixtures. Other means of engaging the graphics panel to the display fixture, according to the type of display fixture employed, also are suitable for the purposes of the present invention. Which ever mounting means is utilized, however, the present invention contemplates attaching that mounting means to the rear surface 13 of the graphics panel using a hinge. This allows the mounting means to be folded inwardly against the graphics panel rear surface 13 when the valance assembly is not installed onto a display fixture.

Although any hinge suitable for attaching both to the mounting bracket 31 and to the rear surface 13 of the graphics panel would be suitable, the present invention contemplates the use of a coextruded polyvinyl chloride hinge. The advantages of using such a coextruded hinge are that it is a unitary element, or one formed into a single piece, and is generally considered a low maintenance item. In other words, a coextruded hinge should bend numerous times without creasing, or forming a failure line, and eventually breaking. Coextruding plastic materials, such as polyvinyl chloride, involves the process in which, for example, plastics having different properties are extruded together to form a unitary element. In this case, two types of polyvinyl chloride (PVC) are extruded together to form a unitary piece capable of bending along its longitudinal mid-portion without forming a failure line. This is due to the fact that the central section of the coextruded hinge is formed of a less rigid type of PVC.

As shown in FIG. 4, an elongate hinge assembly 40 is of the same length as vertically oriented rear edge 33, and is adapted to mount to bracket 31 adjacent to edge 33 and also to rear surface 13 of the graphics panel substantially at each end portion of the panel. Hinge or hinge assembly 0 includes outer, elongate, substantially flat mounting sections 41 which preferably are formed of a fairly rigid form of PVC. Coextruded along with sections 41 is a central hinge section 42 which is comprised of a "softer" of more bendable type of PVC. Sections 41 and 42 are coextruded together so that section 42 is formed as a middle hinge section. When sections 41 are attached to the mounting bracket 31 and to the rear surface 13, respectively, the hinge attached to the mounting bracket to the graphics panel permits the mounting bracket to bias towards and away from the graphics panel rear surface.

The mounting bracket 31 of the hinge assembly can be biased into a mounting position at an angle to the graphics panel rear surface, for example at 90° as shown in FIG. 2, or in a storage position. The storage position of the mounting bracket constitutes the bracket being biased in a position substantially parallel to rear surface 13 or adjacent to or contacting the rear surface. The mounting means of the present invention being hingedly connected to the graphics panel allows the mounting means, or in this case mounting bracket 31, to be placed in the storage position, thereby allowing the valance assemblies of the present invention to be stacked for transportation or storage. Prior to installation of the valance assembly 10 to a merchandising display fixture, the mounting brackets 31 simply are biased away from rear surface 13 as in storage, to a mounting position, for example, normal to the graphics panel. Therefore, no in-store assembly of the present invention is required prior to its installation onto a display fixture. This feature permits an unskilled laborer to readily install the present invention without the need of any tools whatsoever.

Several such valance assemblies can be mounted to the display fixture uprights by inserting the teeth of the mounting brackets into the openings formed in the front surface of the uprights. Since the mounting brackets 31 are substantially planar, two such mounting brackets fit within the same opening 30 of the same upright when two valance assemblies are arranged longitudinally in end-to-end fashion. The valance assemblies, therefore, are supported from the display fixtures in the same manner as the shelving or product supports which typically are supported by the fixtures, although such known shelving and supports do not employ hinges.

Further, when numerous valance assemblies are arranged in end-to-end relationship, the respective channels 23 and 27 of their associated guides 22 and 25, are longitudinally aligned, so that graphics displays or inserts can be slid across the length of the numerous end-to-end, aligned valence assemblies, which together form a single display unit. The ridges 16 and 17 thereby form a decorative border above and below the graphics insert 28, thus completing the decorative valance assembly.

Also as discussed above, many variations may be had with respect to the elements of the disclosed valance assemblies. Therefore, while the invention has been disclosed in preferred forms only, it will be obvious to those skilled in the art that many additions, deletions and modifications can be made therein without departing from the spirit and the scope of the invention as set forth in the following claims.

What is claimed is:

1. A valance assembly adapted to be attached to a display fixture for supporting a graphics insert, comprising:

a graphics panel having a first surface and a second surface opposing said first surface;

retaining means attached to said first surface comprising a pair of spaced guides, each defining channels for receiving respective portions of said graphics insert within said channels to hold said graphics insert between said guides; and mounting means hingedly connected to said second surface for releasably attaching said valance assembly to said display fixture, said mounting means being selectively moveable into both a mounting position and a storage position.

2. The valance assembly of claim 1, said guides being elongate, extruded members, j-shaped in cross-section and positioned onto said first surface so that said channels of each guide open inwardly toward one another.

3. The valance assembly of claim 1, said mounting means comprising a hinge and a mounting bracket attached to said hinge, said mounting bracket further including engagement means for engaging said display fixture.

4. The valance assembly of claim 3, said hinge being a coextruded member having a first mounting section comprises of a first polyvinyl chloride (PVC) material, a bendable section comprises of a second PVC material and a second mounting section also comprises of said first PVC material.

5. The valance assembly of claim 1, wherein the graphics insert is releasably held by the guides.

6. A valance assembly for a point-of-purchase merchandising fixture for supporting a graphics header, comprising an elongate, substantially rigid graphics panel having a front side and a rear side, a first retaining member attached to said front side and a mounting member for releasably attaching said valance assembly to said merchandising fixture, said mounting member hingedly attached to said rear side, said mounting member being moveable between a mounting position in which said mounting member extends away from said rear side for engagement with the merchanising fixture and a storage position in which said mounting member extends substantially parallel to said rear side.

7. The valance assembly of claim 6, and a second retaining member attached to said front side and spaced from said first retaining member, said graphics header being slidably received between said first and second retaining members to be held adjacent to said front side.

8. The valance assembly of claim 6, said mounting member comprising a hinge and a mounting panel attached to said hinge.

9. The valance assembly of claim 8, said hinge being comprised of coextruded plastic.

10. The valance assembly of claim 9, said plastic being polyvinyl chloride.

11. A valance assembly for a point-of-purchase merchandising fixture for supporting a graphics header, comprising an elongate, substantially rigid graphics panel having a front side and rear side, a first retaining member attached to said front side and a mounting member for releasably attaching said valance assembly to said merchandising fixture, said mounting member attached to said rear side, said mounting member being movable between a mounting position in which said mounting member extends away from said rear side for engagement with the merchandising fixture and a storage position in which said mounting member extends substantially parallel to said rear side.

12. The valance assembly of claim 11, and a second retaining member attached to said front side and spaced from said second retaining member, said graphics header being slidably received between said first and second retaining members to be held adjacent to said front side.

13. The valance assembly of claim 11, said mounting member comprising a hinge and a mounting panel attached to said hinge.

14. The valance assembly of claim 11, said hinge being comprised of coextruded plastic.

15. The valance assembly of claim 14, said plastic being polyvinyl chloride.

16. A valance assembly adapted to be attached to a display fixture for supporting a graphics insert, comprising:

a graphics panel having a first surface and a second surface opposing said first surface;

retaining means attached to said first surface for holding said graphics insert;

mounting means hingedly connected to said second surface for releasably attaching said valance assembly to said display fixture, said mounting position and a storage position, said retaining means comprising a pair of spaced guides, each defining channels for receiving a portion of said graphics insert within said channels and between said guides, and said guides being elongate, extruded members, j-shaped in cross-section and positioned onto said first surface so that said channels of each guide open inwardly toward one another.

17. A valance assembly adapted to be attached to a display fixture for supporting a graphics insert, comprising:

a graphics panel having a first surface and a second surface opposing said first surface;

retaining means attached to said first surface for holding said graphics insert;

mounting means hingedly connected to said second surface for releasably attaching said valance assembly to said display fixture, said mounting means being selectively moveable into both a mounting position and a storage position, said mounting means comprising a hinge and a mounting bracket attached to said hinge, said mounting bracket further including engagement means for engaging said display fixture.

18. The valance assembly of claim 17, said hinge being a coextruded member having a first mounting section comprised of a first polyvinyl chloride material, a bendable section comprised of a second polyvinyl chloride material and a second mounting section also comprised of said first polyvinyl chloride material.

* * * * *

UNITED STATES PATENT AND TRADEMARK OFFICE

CERTIFICATE OF CORRECTION

PATENT NO. : 5,465,516
DATED : November 14, 1995
INVENTOR(S) : David J. Stabile

It is certified that error appears in the above-indentified patent and that said Letters Patent is hereby corrected as shown below:

In column one, line 36 change "advertizing" to --advertising--.

In column four, line 4 change "12o" to --12.--.

In column five, line 13 change "0" to --40--.

In column five, line 17 change the second "of" to --or--.

In column six, line 33 change "comprises" to --comprised--.

In column six, line 34 change "comprises" to --comprised--.

In column seven, line 27 after "said display fixture, said" insert --mounting means being selectively movable into both a--.

Signed and Sealed this

Thirteenth Day of August, 1996

*Attest:*

Bruce Lehman

BRUCE LEHMAN

*Attesting Officer*

*Commissioner of Patents and Trademarks*